US011322006B2

(12) United States Patent
Zu et al.

(10) Patent No.: US 11,322,006 B2
(45) Date of Patent: May 3, 2022

(54) SMOKE DETECTOR

(71) Applicant: Carrier Corporation, Palm Beach Gardens, FL (US)

(72) Inventors: Mingyan Zu, Hebei (CN); Zhanlin Yang, Hebei (CN); Zhihua Gao, Hebei (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/252,634

(22) PCT Filed: Oct. 23, 2019

(86) PCT No.: PCT/US2019/057538
§ 371 (c)(1),
(2) Date: Dec. 15, 2020

(87) PCT Pub. No.: WO2020/106398
PCT Pub. Date: May 28, 2020

(65) Prior Publication Data

US 2021/0295667 A1 Sep. 23, 2021

(30) Foreign Application Priority Data

Nov. 20, 2018 (CN) ..... 201811383578.4

(51) Int. Cl.
*G08B 17/107* (2006.01)
*G08B 17/113* (2006.01)
(Continued)

(52) U.S. Cl.
CPC ..... *G08B 17/107* (2013.01); *G08B 17/113* (2013.01); *G08B 29/04* (2013.01); *G08B 29/18* (2013.01)

(58) Field of Classification Search
CPC .... G08B 17/107; G08B 17/113; G08B 29/04; G08B 29/18
(Continued)

(56) References Cited

U.S. PATENT DOCUMENTS 4,761,557 A * 8/1988 Sasaki ..... G08B 17/113 250/381
5,059,811 A 10/1991 King et al.
(Continued)

FOREIGN PATENT DOCUMENTS

CN 206441309 U 8/2017
CN 206946654 U 1/2018
(Continued)

OTHER PUBLICATIONS

International Search Report dated Jan. 13, 2020; International Application No. PCT/US2019/057538; International Filing Date Oct. 23, 2019 (5 pgs).
(Continued)

*Primary Examiner* — John A Tweel, Jr.
(74) *Attorney, Agent, or Firm* — Cantor Colburn LLP

(57) ABSTRACT

A smoke detector includes: a housing; a sensing chamber in the housing, wherein in the sensing chamber, a first light emitter and a first light receiver that are disposed at the periphery of the sensing chamber and facing a middle portion of the sensing chamber are included, a first baffle is included in the sensing chamber, the first baffle is disposed adjacent to the first light emitter and includes a baffle body and a branch portion, the baffle body extends from the periphery of the sensing chamber toward the middle portion, and the branch portion comprises a plurality of sub-baffles branching off the baffle body; and a circuit board electrically connected to the first light emitter and the first light receiver respectively.

10 Claims, 4 Drawing Sheets

(51) Int. Cl.
*G08B 29/04* (2006.01)
*G08B 29/18* (2006.01)

(58) Field of Classification Search
USPC ..... 340/630
See application file for complete search history.

(56) References Cited

U.S. PATENT DOCUMENTS

| | | | |
|---|---|---|---|
| 5,451,931 | A | 9/1995 | Muller et al. |
| 5,486,816 | A | 1/1996 | Ariga et al. |
| 5,552,765 | A | 9/1996 | Vane et al. |
| 6,218,950 | B1 | 4/2001 | Politze et al. |
| 6,831,289 | B1 | 12/2004 | Preikszas et al. |
| 7,038,189 | B2 | 5/2006 | Kawai |
| 8,933,811 | B2 | 1/2015 | Højmose |
| 9,541,501 | B2 | 1/2017 | Allemann et al. |
| 9,659,485 | B2 | 5/2017 | Piccolo, III |
| 9,679,468 | B2 | 6/2017 | Piccolo |
| 9,792,793 | B2 | 10/2017 | Baxendell et al. |
| 10,054,542 | B2 | 8/2018 | Iguchi et al. |
| 11,069,224 | B1 * | 7/2021 | Hsieh ..... G08B 29/183 |
| 2012/0262714 | A1 | 10/2012 | Gonzales |
| 2017/0046935 | A1 | 2/2017 | Allemann et al. |

FOREIGN PATENT DOCUMENTS

| | | | |
|---|---|---|---|
| EP | 0821331 | B1 | 10/2002 |
| EP | 2940665 | A2 | 11/2015 |
| EP | 3214425 | A1 | 9/2017 |
| JP | 2008310732 | A | 12/2008 |
| JP | 2010040009 | A | 2/2010 |
| RU | 179257 | U1 | 5/2018 |
| WO | 2015032417 | A1 | 3/2015 |

OTHER PUBLICATIONS

Written Opinion dated Jan. 13, 2020; International Application No. PCT/US2019/057538; International Filing Date Oct. 23, 2019 (7 pgs).

* cited by examiner

SMOKE DETECTOR

CROSS REFERENCE TO RELATED APPLICATIONS

This application is a National Stage application of PCT/US2019/057538, filed Oct. 23, 2019, which claims the benefit of China Application No. 201811383578.4 filed Nov. 20, 2018, both of which are incorporated by reference in their entirety herein.

FIELD OF THE INVENTION

The present disclosure relates to the field of fire safety, and in particular to a smoke detector for detecting a fire situation.

BACKGROUND OF THE INVENTION

Smoke detectors, also known as smoke-sensitive fire detectors or smoke-sensing detectors, are commonly used in buildings to detect smoke generated in a fire and then send a warning signal. The smoke detector typically includes a sensing chamber in which a light emitter, a light receiver and a sensing area are included. When the smoke reaches a certain concentration in the sensing area, light emitted by the light emitter is scattered to the light receiver at an intensity that reaches a critical value, thereby generating a signal and sending an alarm.

The cost of a smoke detector depends on the size of the sensing chamber thereof. As the size of the sensing chamber decreases, a distance between a side wall of the sensing chamber and the light emitter will decrease, resulting in stronger background light which may include a scattered portion of the light emitted by the light emitter and a light refracted or reflected by the wall of the sensing chamber. Such background light as a base noise may affect the normal operation of the smoke detector.

SUMMARY OF THE INVENTION

An object of the present disclosure is to solve or at least alleviate the problems in the prior art.

According to some aspects, a smoke detector is provided, which includes:

a housing;

a sensing chamber in the housing, wherein in the sensing chamber, a first light emitter and a first light receiver that are disposed at the periphery of the sensing chamber and facing a middle portion of the sensing chamber are included, a first baffle is included in the sensing chamber, the first baffle is disposed adjacent to the first light emitter and includes a baffle body and a branch portion, the baffle body extends from the periphery of the sensing chamber toward the middle portion, and the branch portion includes a plurality of sub-baffles branching off the baffle body; and a circuit board electrically connected to the first light emitter and the first light receiver respectively.

Optionally, in the smoke detector, some of the sub-baffles extend toward the radial direction of the first light emitter.

Optionally, in the smoke detector, the branch portion is divergent in cross-section.

Optionally, in the smoke detector, the sensing chamber is cylindrical.

Optionally, in the smoke detector, the first light emitter and the first light receiver are arranged at a central angle between 90° and 180°, a second light emitter is disposed in the sensing chamber, and the second light emitter is located between the first light emitter and the first light receiver and spaced apart from the first light receiver by a central angle of less than 90°; wherein the first baffle is located between the first light emitter and the second light emitter, some of the sub-baffles extend toward the radial direction of the first light emitter, and some of the sub-baffles extend toward the radial direction of the second light emitter.

Optionally, in the smoke detector, a second baffle extending from the periphery of the sensing chamber toward the middle portion is further disposed between the second light emitter and the first light receiver.

Optionally, in the smoke detector, a third baffle is further disposed at the outer side of the first light receiver, and an inner end of the third baffle extends toward the radial direction of the first light receiver.

Optionally, in the smoke detector, the first light emitter and the first light receiver are spaced apart by a central angle between 90° and 180°, a second light receiver is disposed in the sensing chamber, and the second light receiver is located between the first light emitter and the first light receiver and spaced apart from the first light emitter by a central angle of less than 90°, wherein the first baffle is located between the first light emitter and the second light receiver.

Optionally, in the smoke detector, a second baffle extending from the periphery of the sensing chamber to the middle portion is further disposed between the second light receiver and the first light receiver, at the outer side of the first light receiver is further provided with a third baffle, and an inner end of the third baffle extends toward the radial direction of the first light receiver.

Optionally, in the smoke detector, the first light emitter and the first light receiver are spaced apart by a central angle of less than 90°, at the outer side of the first light receiver is further provided with a third baffle, and an inner end of the third baffle extends toward the radial direction of the first light receiver.

Optionally, in the smoke detector, the sensing chamber includes an opening, a sidewall and a bottom wall, and the sidewall of the sensing chamber is toothed.

Optionally, in the smoke detector, the sensing chamber is formed by assembling a smoke guiding cover, a labyrinth body and a labyrinth base.

Optionally, in the smoke detector, the first baffle is fixed to the labyrinth base.

Optionally, in the smoke detector, the labyrinth base defines a light emitter holder and a light receiver holder, and the first light emitter and the first light receiver are respectively located in the light emitter holder and the light receiver holder, wherein pins of the first light emitter and the first light receiver are connected to the circuit board after passing through the labyrinth base, and the labyrinth body defines a light emitter cover and a light receiver cover; when the labyrinth body and the labyrinth base are assembled together, the first light emitter is fixed between the light emitter holder and the light emitter cover, and the first light receiver is fixed between the light receiver holder and the light receiver cover.

The smoke detector according to the present disclosure has a simple structure, effectively weakens a background light in the sensing chamber, and ensures a normal operation of the smoke detector especially in a case where a volume of the sensing chamber is small.

BRIEF DESCRIPTION OF THE DRAWINGS

The contents of the present disclosure will become more easily understood with reference to the accompanying drawings. Those skilled in the art can readily appreciate that the drawings are for illustrative purposes only, instead of being intended to limit the scope of protection of the present disclosure. In addition, similar numbers in the drawings are used to indicate similar parts, wherein.

DETAILED DESCRIPTION OF THE EMBODIMENT(S) OF THE INVENTION

It will be readily understood that, based on the technical solutions of the present disclosure, those skilled in the art can propose various alternative embodiments and implementations without departing from the true spirit of the present disclosure. Therefore, the following detailed description and the accompanying drawings are merely exemplary description of the technical solutions of the present disclosure, which shall not be deemed as the whole of the present disclosure or as limiting or restricting the technical solutions of the present disclosure.

Such orientation terms as upper, lower, left, right, front, rear, front side, back side, top, bottom or the like that are mentioned or may be mentioned in this description are defined with respect to the configurations shown in the individual drawings. They are relative concepts and thus possibly vary according to their different locations and different usage states. Therefore, these or other orientation terms shall not be interpreted as limiting terms.

Figure 1:
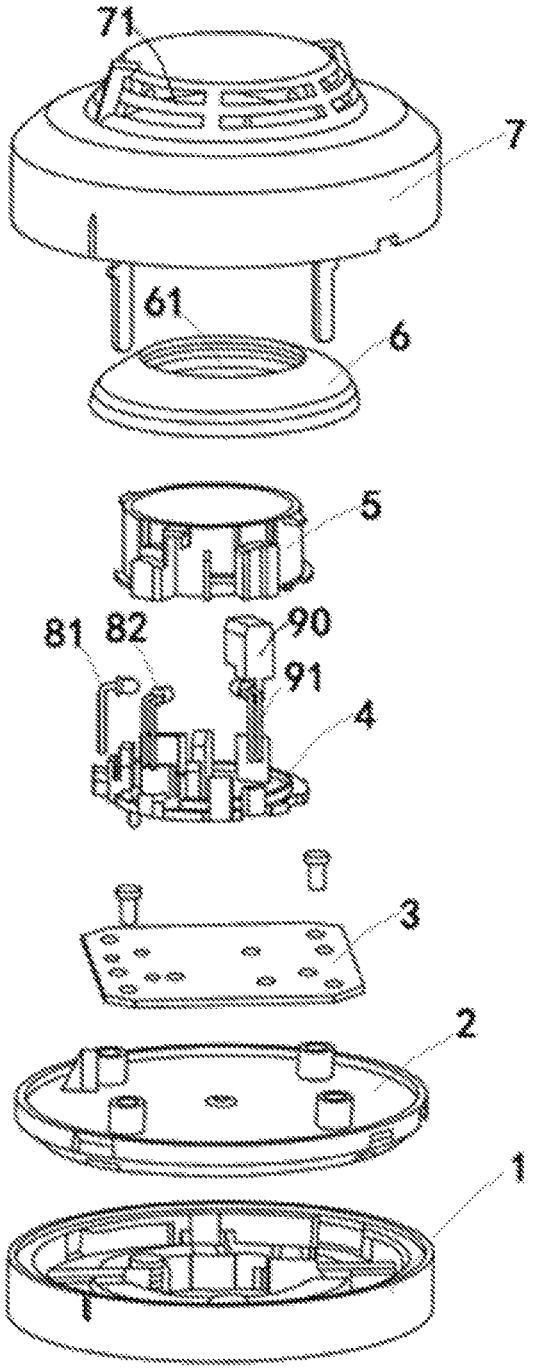
FIG. 1 shows an exploded view of a smoke detector according to an embodiment of the present disclosure.

Referring first to FIG. 1, an exploded view of a smoke detector according to an embodiment of the present disclosure is shown.

In some embodiments, the smoke detector may include:

a mounting base 1 configured to fix the smoke detector to a wall surface, such as a ceiling;

a lower housing 2 and an upper housing 7, wherein the lower housing 2 and the upper housing 7 can be connected together to form an outer shell of the smoke detector, in which a sensing chamber is located, and the upper housing 7 may have a smoke inlet 71 to allow smoke to enter the sensing chamber of the smoke detector;

the sensing chamber, wherein in the present embodiment, the sensing chamber may be composed of a smoke guiding cover 6, a labyrinth body 5 and a labyrinth base 4. The smoke guiding cover 6 may have a smoke inlet 61 to direct the smoke to a sensing area in the middle portion of the sensing chamber. A first light emitter 81, an optional second light emitter 82, and a first light receiver 91 are disposed in the sensing chamber. The first light emitter 81 and the second light emitter 82 may be, for example, an IRLED, and the first light receiver 91 may be, for example, a photosensitive diode. The first light receiver 91 may be provided with a shield cover 90 to avoid interference. The first light emitter 81, the second light emitter 82 and the first light receiver 91 are disposed at the periphery of the sensing chamber and facing the sensing area in the middle portion of the sensing chamber; and a circuit board 3, which is located outside the sensing chamber, such as under the labyrinth base 4 and electrically coupled with the first light emitter 81, the second light emitter 82 and/or the first light receiver 91. For example, the circuit board 3 supplies power to the first light emitter 81 and the second light emitter 82 and receives a signal from the first light receiver 91.

This type of smoke detector operates following this principle: when smoke has not yet entered the sensing chamber, the light receiver receives only a small amount of background light (also referred to as base noise), which may be a scattered light of the light emitted by the light emitter, or a reflected light from an inner wall of the sensing chamber. When the smoke enters the sensing area of the sensing chamber, the light emitted by the light emitter will be refracted by the smoke to the light receiver, causing the intensity of light received by the light receiver to increase to a critical value. For example, the light receiver may be a photosensitive diode, which sends a signal when the intensity of light increases to the critical value, so that an alarm system or the like may be activated.

As described in the background art, as the volume of the sensing chamber becomes smaller, the background light or base noise in the sensing chamber will increase, thus affecting a normal operation of the smoke detector. The smoke detector according to the embodiment of the present disclosure provides the following structure to attenuate background light. Specifically, referring to FIGS. 2, 3 and 4, the smoke detector according to the embodiment of the present disclosure further includes a first baffle 42 in the sensing chamber. The first baffle 42 is disposed adjacent to the first light emitter 81 located in a light emitter holder 47, and the first baffle 42 includes a baffle body 421 extending from the periphery of the sensing chamber toward the middle portion, and a branch portion 422 extending from the baffle body 421, the branch portion 422 including a plurality of sub-baffles 4221, 4222, 4223 and 4224 branching off the baffle body 421. In the illustrated embodiment, the branch portion 422 may be divergent in cross-section, similar to the shape of a hand, including four sub-baffles 4221, 4222, 4223 and 4224. In alternative embodiments, the branches 422 may have other shapes and may have different numbers of sub-baffles, such as two, three, or five, and the like. The unique structure of the first baffle 42 effectively weakens a scattered portion of the light emitted from the light emitter 81 and a reflected light from the side wall, thereby effectively reducing the background light in the sensing chamber.

In some embodiments, some of the sub-baffles are tilted or referred as deflected, or referred to as extending toward the radial direction of the first light emitter 81. In the embodiment shown in FIGS. 2 to 4, the sub-baffles 4223, 4224 extend toward the radial direction of the first light emitter 81, and the sub-baffle 4221 extend toward the radial direction of the second light emitter 82, so that scattered portions of lights emitted by the first light emitter 81 and the second light emitter 82 are effectively blocked. On the other hand, the sub-baffles 4221, 4222, 4223, 4224 will not block the main light path, and thus will not affect a normal operation of the smoke detector.

Figure 2:
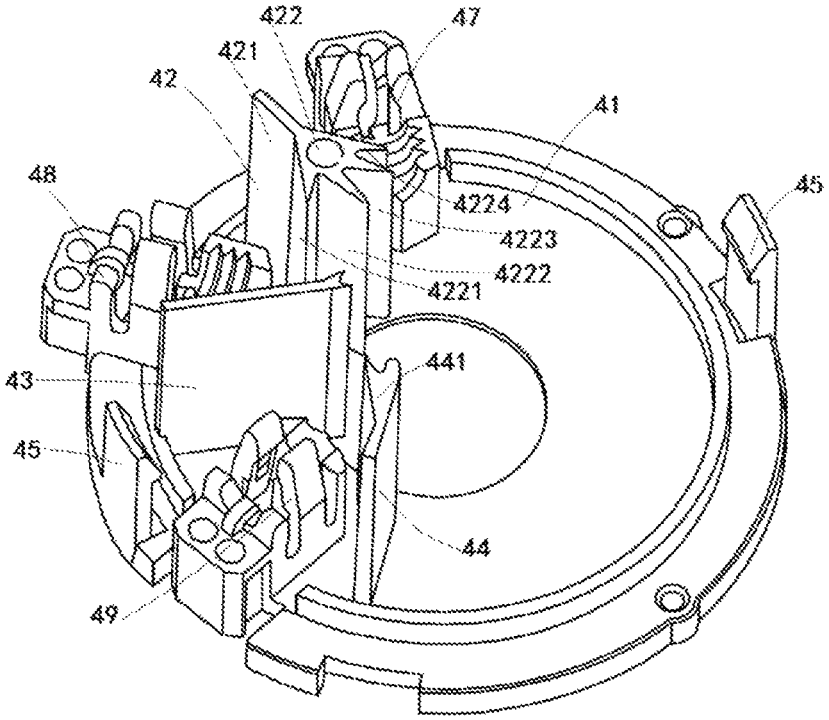
FIG. 2 shows a perspective view of a labyrinth base in a smoke detector according to an embodiment of the present disclosure.
Figure 3:
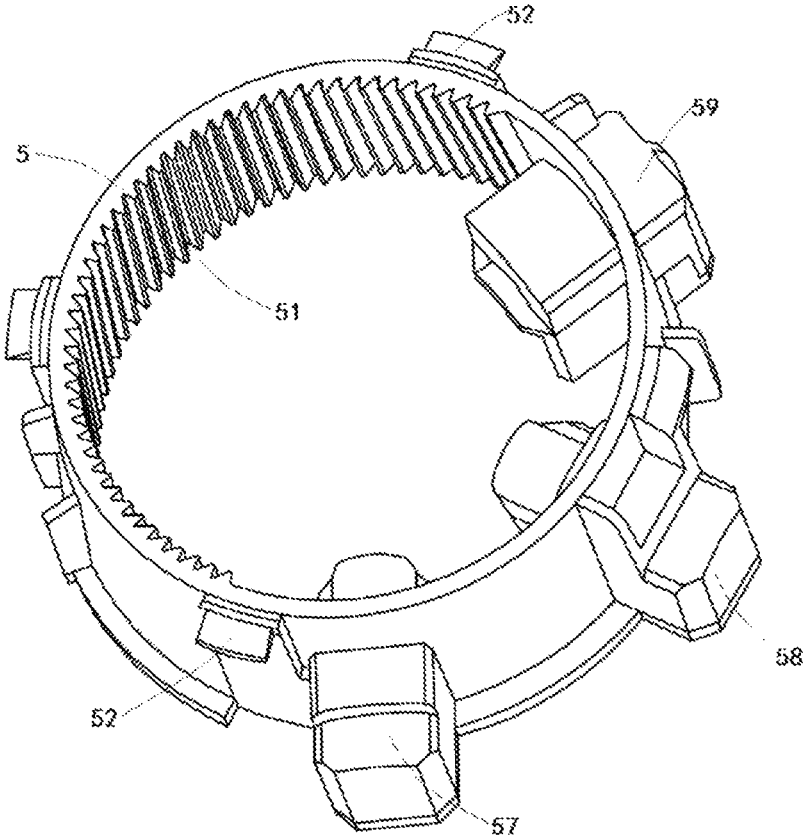
FIG. 3 shows a perspective view of a labyrinth body in a smoke detector according to an embodiment of the present disclosure.

Referring, to FIGS. 2 and 3, in some embodiments, the sensing chamber may include an opening, a side wall, and a bottom wall. In the illustrated embodiment, the opening of the sensing chamber is constituted by a smoke inlet 61 of a smoke guiding cover 6, the side wall of the sensing chamber is constituted by a side wall 51 of the labyrinth body 5, and the bottom wall of the sensing chamber is constituted by a bottom wall 41 of the labyrinth base 4. In some embodiments, the sensing chamber is substantially cylindrical, and in alternative embodiments, the sensing chamber may have other suitable shapes. In some embodiments, the side wall of the sensing chamber, i.e., the side wall 51 of the labyrinth body 5, is toothed to effectively suppress reflection of light by the side wall, thereby further weakening the background light. In some embodiments, as shown, the first baffle 42 and optional a second baffle 43 and a third baffle 44 are each fixed to the labyrinth base 4. Alternatively, the baffles may also extend out from the side wall of the labyrinth body or the smoke guiding cover. In some embodiments, the labyrinth base 4 defines light emitter holders 47, 48 and a light receiver holder 49, wherein the first light emitter 81, the second light emitter 82, and the first light receiver 91 are located in the light emitter holders 47, 48 and the light receiver holder 49 respectively. Pins of the first light emitter 81, the second light emitter 82 and the first light receiver 91 are connected to the circuit board 3 after passing through the labyrinth base 4. The labyrinth body 5 defines light emitter covers 57, 58 and a light receiver cover 59. After the labyrinth body 5 and the labyrinth base 4 are assembled together, the first light emitter 81 is fixed between the light emitter holder 47 and the light emitter cover 57, the second light emitter 82 is fixed between the light emitter holder 48 and the light emitter cover 58, and the first light receiver 91 is fixed between the light receiver holder 49 and the light receiver cover 59.

Figure 4:
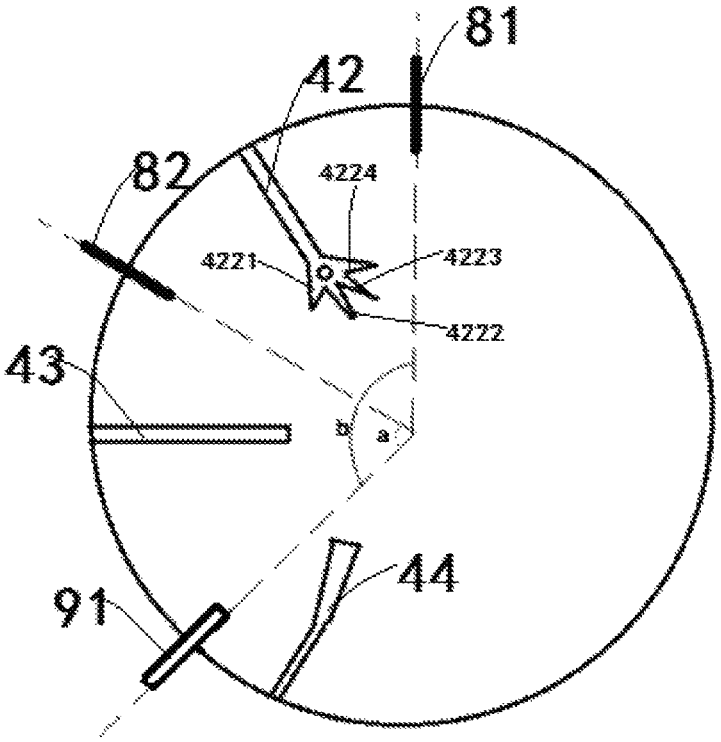
FIG. 4 shows an arrangement view of a sensing chamber of a smoke detector according to an embodiment of the present disclosure.

Referring specifically to FIG. 4, in this embodiment, the first light emitter 81 and the first light receiver 91 are arranged at a central angle b between 90° and 180°, a second light emitter 82 is disposed in the sensing chamber, and the second light emitter 82 is located between the first light emitter 81 and the first light receiver 91 and spaced apart from the first light receiver 91 by a central angle a of less than 90°; wherein the first baffle 42 is located between the first light emitter 81 and the second light emitter 82, part of the sub-baffles 4223, 4224 extend toward the radial direction of the first light emitter 81, and part of the sub-baffles 4221 extend toward the radial direction of the second light emitter 82. In some embodiments, a second baffle 43 extending from the periphery of the sensing chamber toward the middle portion is further disposed between the second light emitter 82 and the first light receiver 91. The second baffle 43 blocks part of the background light. In some embodiments, a third baffle 44 is further disposed at the outer side of the first light receiver 91, and an inner end (the end near the center) of the third baffle 44 extends toward the radial direction of the first light receiver 91. The third baffle 44 further weakens the background light that may be incident on the first light receiver 91.

Figure 5:
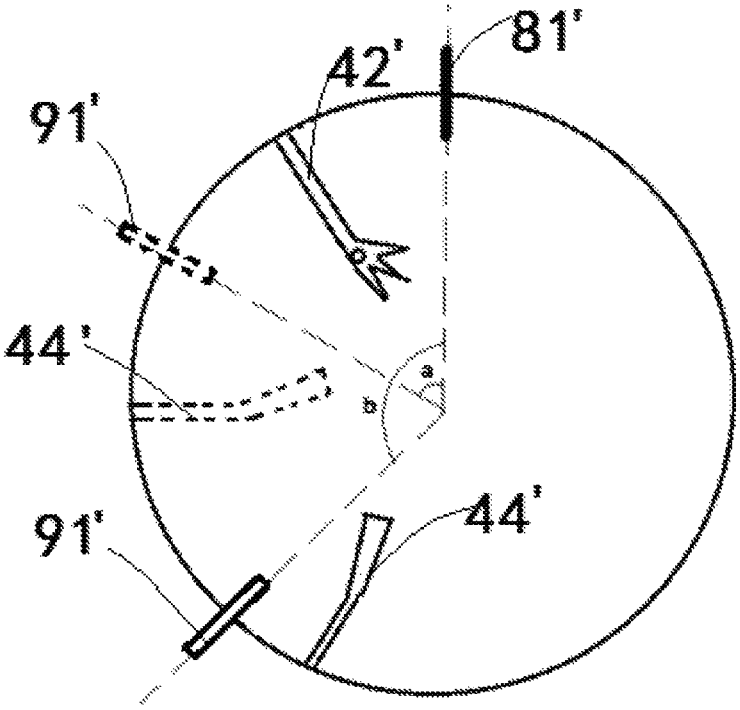
FIG. 5 shows a variation of a sensing chamber of a smoke detector according to an embodiment of the present disclosure.

With continued reference to FIG. 5, a variation of the sensing chamber according to the present disclosure is illustrated. In this embodiment, a first emitter 81' and a first receiver 91' are included in the sensing chamber. In this embodiment, a first baffle 4T may include a sub-baffle that extends toward the radial direction of the first emitter 81'. In some embodiments, the first emitter 81' and the first receiver 91' may be spaced apart by a central angle b of 90° to 180°. In an alternative embodiment shown by dashed lines, the first emitter 81' and the first receiver 91' (shown in dashed lines) may be spaced apart by a central angle a within 90°. Similarly, in some embodiments, at the outer side of the first light receiver 91' may also be provided with a third baffle 44', and an inner end of the third baffle 44' extends toward the radial direction of the first light receiver 91'.

Figure 6:
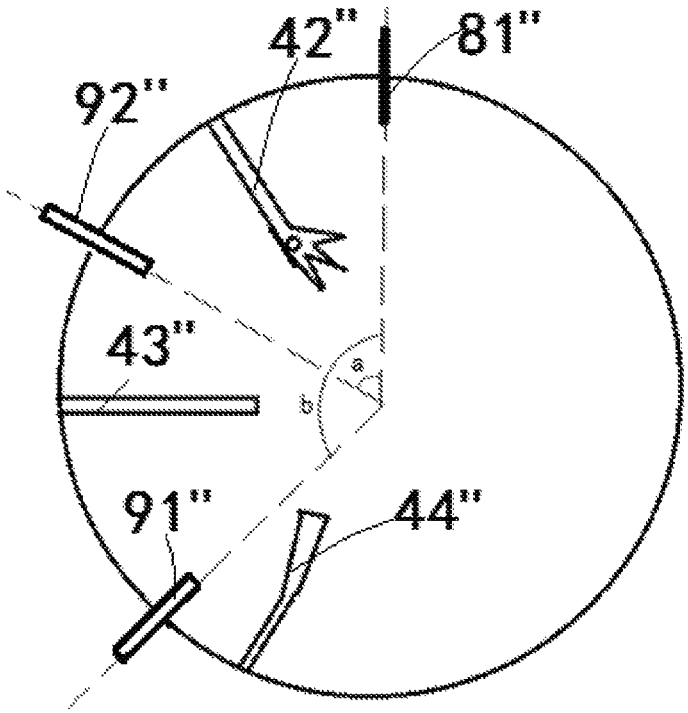
FIG. 6 shows another variation of a sensing chamber of a smoke detector according to an embodiment of the present disclosure.

With continued reference to FIG. 6, a variation of the sensing chamber according to the present disclosure is illustrated. In this embodiment, a first light emitter 81" and a first light receiver 91" are spaced apart by a central angle b between 90° and 180°, a second light receiver 92" is disposed in the sensing chamber, and the second light receiver 92" is located between the first light emitter 81" and the first light receiver 91" and spaced apart from the first light emitter 81" by a central angle a of less than 90°, wherein a first baffle 42" is located between the first light emitter 81" and the second light receiver 92". In some embodiments, a second baffle 43" extending from the periphery of the sensing chamber to the middle portion is further disposed between the second light receiver 92" and the first light receiver 91", at the outer side of the first light receiver 91" is further provided with a third baffle 44", and an inner end of the third baffle 44" extends toward the radial direction of the first light receiver 91".

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. It should be understood that these modifications or changes should be included within the scope of protection of the present disclosure.

What is claimed is:

1. A smoke detector, comprising:

a housing;

a sensing chamber in the housing, wherein in the sensing chamber, a first light emitter and a first light receiver are disposed at the periphery of the sensing chamber and facing a middle portion of the sensing chamber;

a first baffle in the sensing chamber, the first baffle disposed adjacent to the first light emitter and including a baffle body and a branch portion, the baffle body extending from the periphery of the sensing chamber toward the middle portion, and the branch portion including a plurality of sub-baffles branching off the baffle body;

the first light emitter and the first light receiver arranged at a central angle between 90° and 180°;

a second light emitter disposed in the sensing chamber, the second light emitter located between the first light emitter and the first light receiver and spaced apart from the first light receiver by a central angle of less than 90°, wherein the first baffle is located between the first light emitter and the second light emitter;

a second baffle extending from the periphery of the sensing chamber toward the middle portion and disposed between the second light emitter and the first light receiver, the second baffle extending beyond a distal end of the second light emitter, the second baffle extending beyond a distal end of the first light receiver;

a third baffle disposed at the outer side of the first light receiver, an inner end of the third baffle extending toward the radial direction of the first light receiver; and a circuit board electrically connected to the first light emitter and the first light receiver respectively.

2. The smoke detector according to claim 1, wherein some of the sub-baffles extend toward the radial direction of the first light emitter.

3. The smoke detector according to claim 1, wherein the branch portion is divergent in cross-section.

4. The smoke detector according to claim 1, wherein the sensing chamber is cylindrical.

5. The smoke detector according to claim 1, wherein some of the sub-baffles extend toward the radial direction of the first light emitter, and some of the sub-baffles extend toward the radial direction of the second light emitter.

6. The smoke detector according to claim 1, wherein the sensing chamber comprises an opening, a sidewall and a bottom wall, and the sidewall of the sensing chamber is toothed.

7. The smoke detector according to claim 1, wherein the sensing chamber is formed by assembling a smoke guiding cover, a labyrinth body and a labyrinth base.

8. The smoke detector according to claim 7, wherein the first baffle is fixed to the labyrinth base.

9. The smoke detector according to claim 7, wherein the labyrinth base defines a light emitter holder and a light receiver holder, and the first light emitter and the first light receiver are respectively located in the light emitter holder and the light receiver holder, wherein pins of the first light emitter and the first light receiver are connected to the circuit board after passing through the labyrinth base, and the labyrinth body defines a light emitter cover and a light receiver cover; when the labyrinth body and the labyrinth base are assembled together, the first light emitter is fixed between the light emitter holder and the light emitter cover, and the first light receiver is fixed between the light receiver holder and the light receiver cover.

10. A smoke detector, comprising:

a housing;

a sensing chamber in the housing, wherein in the sensing chamber, a first light emitter and a first light receiver are disposed at the periphery of the sensing chamber and facing a middle portion of the sensing chamber;

a first baffle in the sensing chamber, the first baffle disposed adjacent to the first light emitter and includes a baffle body and a branch portion, the baffle body extending from the periphery of the sensing chamber toward the middle portion, and the branch portion including a plurality of sub-baffles branching off the baffle body;

wherein the first light emitter and the first light receiver are spaced apart by a central angle between 90° and 180°;

a second light receiver disposed in the sensing chamber, the second light receiver located between the first light emitter and the first light receiver and spaced apart from the first light emitter by a central angle of less than 90°, wherein the first baffle is located between the first light emitter and the second light receiver;

a second baffle extending from the periphery of the sensing chamber to the middle portion and disposed between the second light receiver and the first light receiver, the second baffle extending beyond a distal end of the second light receiver, the second baffle extending beyond a distal end of the first light receiver; and a third baffle at an outer side of the first light receiver, an inner end of the third baffle extending toward the radial direction of the first light receiver.

* * * * *